US011401939B2

(12) United States Patent
Decker

(10) Patent No.: US 11,401,939 B2
(45) Date of Patent: Aug. 2, 2022

(54) AXIAL FAN CONFIGURATIONS

(71) Applicant: Xcelaero Corporation, San Luis Obispo, CA (US)

(72) Inventor: John Decker, Cypress, TX (US)

(73) Assignee: Bascom Hunier Technologies, Inc., Baton Rouge, LA (US)

( * ) Notice: Subject to any disclaimer, the term of this patent is extended or adjusted under 35 U.S.C. 154(b) by 38 days.

(21) Appl. No.: 16/071,462

(22) PCT Filed: Jan. 20, 2017

(86) PCT No.: PCT/US2017/014447
§ 371 (c)(1),
(2) Date: Jul. 19, 2018

(87) PCT Pub. No.: WO2017/127754
PCT Pub. Date: Jul. 27, 2017

(65) Prior Publication Data

US 2020/0056618 A1 Feb. 20, 2020

Related U.S. Application Data

(60) Provisional application No. 62/286,168, filed on Jan. 22, 2016.

(51) Int. Cl.
*F04D 19/00* (2006.01)
*F04D 19/02* (2006.01)
(Continued)

(52) U.S. Cl.
CPC ..... *F04D 19/007* (2013.01); *F04D 19/024* (2013.01); *F04D 25/06* (2013.01);
(Continued)

(58) Field of Classification Search
CPC .... F04D 19/002; F04D 19/007; F04D 19/024; F04D 25/0613; F04D 25/08;
(Continued)

(56) References Cited

U.S. PATENT DOCUMENTS 2,592,471 A * 4/1952 Sawyer ..... F04D 19/002 415/192
8,157,518 B2 * 4/2012 Decker ..... F04D 29/384 415/211.2
(Continued)

FOREIGN PATENT DOCUMENTS

CN 1288350 C 11/2004
DE 197 14 531 A1 2/1998
(Continued)

*Primary Examiner* — Courtney D heinle
*Assistant Examiner* — Michael K. Reitz
(74) *Attorney, Agent, or Firm* — Henry C. Query, Jr.

(57) ABSTRACT

A two stage axial fan includes a tubular fan housing, first and second motors which are positioned in series in the fan housing, a first impeller which is positioned in the fan housing and is driven by the first motor, and a second impeller which is positioned in the fan housing and is driven by the second motor. The first motor is positioned on a first foot-mounted motor support structure which is connected to the fan housing and the second motor is positioned on a second foot-mounted motor support structure which is connected to the fan housing.

18 Claims, 9 Drawing Sheets

(51) Int. Cl.

| | |
|---|---|
| ***F04D 25/06*** | (2006.01) |
| ***F04D 29/62*** | (2006.01) |
| *F04D 29/38* | (2006.01) |
| *F04D 29/56* | (2006.01) |

(52) U.S. Cl.
CPC ..... *F04D 29/384* (2013.01); *F04D 29/56* (2013.01); *F04D 29/626* (2013.01)

(58) Field of Classification Search
CPC ..... F04D 29/384; F04D 29/54; F04D 29/56; F04D 29/542; F04D 29/626
See application file for complete search history.

(56) References Cited

U.S. PATENT DOCUMENTS

| | | | | |
|---|---|---|---|---|
| 8,328,522 | B2 * | 12/2012 | Harman | F04D 29/384 416/223 R |
| 8,951,012 | B1 | 2/2015 | Santoro | |
| 2003/0194313 | A1 | 10/2003 | Lin et al. | |
| 2007/0059155 | A1 | 3/2007 | Ishihara et al. | |
| 2008/0031723 | A1 * | 2/2008 | Yoshida | F04D 19/007 415/68 |
| 2008/0219849 | A1 | 9/2008 | Decker et al. | |
| 2010/0054931 | A1 | 3/2010 | Yoshida | |
| 2012/0257957 | A1 | 10/2012 | Yanagisawa et al. | |
| 2015/0127188 | A1 * | 5/2015 | Mundt | F04D 19/024 700/300 |
| 2017/0122327 | A1 * | 5/2017 | Maier | F04D 29/325 |

FOREIGN PATENT DOCUMENTS

| | | |
|---|---|---|
| GB | 323231 | 12/1929 |
| GB | 399619 | 10/1933 |

* cited by examiner

AXIAL FAN CONFIGURATIONS

The present invention is directed to an axial fan. More particularly, the present invention is directed to a two stage counter-rotating or co-rotating axial fan which provides high flow rates over a broad operating range. The present invention is also directed to a two stage counter-rotating fan which is suitable for high impedance while being relatively small and lightweight, and to a system of fan components which are configurable into a plurality of individual axial fans.

BACKGROUND OF THE INVENTION

Industrial fans typically use AC induction motors for their low cost, wide availability, and high reliability. In some industrial applications, the rotational speed of the fan is required to be below a certain level. Reduced rotational speed is also considered a valued characteristic for safety and increased bearing life. In other instances, fans may use a 2-pole induction motor that rotates at the maximum speed possible for that motor type in order to maximize the flow and pressure delivery.

Many prior art fans use a direct drive tube-axial (TA) or vane-axial (VA) architecture, such as shown in FIGS. 1 and 2, respectively. These are single stage fans which include a motor, a motor support, an impeller, and for VA fans, an outlet guide vane assembly. For a fixed rotational speed, the aerodynamic design of the impeller sets the flow rate the fan can achieve, but the impeller design is limited by the amount of shaft power the motor can deliver. Fitting the fan with a higher power motor would require a different impeller aerodynamic design to utilize the additional shaft power to provide a higher flow rate. However, a higher power motor in general will have a larger diameter, and when the motor is incorporated inside a fan duct, such as in a direct drive configuration, the larger diameter motor may be too big for the fan duct, which will restrict the flow area and negatively impact fan flow rate and efficiency. A means to introduce more shaft power without increasing motor diameter is therefore needed.

Placing two motors in series provides up to twice the available shaft power for the same motor diameter. However, it is commonly known that placing fans in series results in a substantial increase in pressure rise but only a small increase in flow rate. An example performance comparison of a single VA fan, two identical VA fans in series, and a counter-rotating (CR) fan is shown in FIG. 3. Comparing the single fan curve to the two-in-series fan curve, it is clear that two fans in series have approximately twice the pressure rise of the single fan. During operation, the flow rate delivered by the fan corresponds to the intersection of the fan and system curves. Therefore, for fixed system impedance the two-in-series fan results in an increase in flow and pressure rise. For applications with low system impedance, however, the flow increase is small. The CR fan uses the same impeller as the VA fan for its first impeller, and the second impeller is designed to operate at the same speed and to draw the same shaft power as the first impeller. Similar to two VA fans in series, the CR fan also provides an increase in pressure rise. In this case, the CR fan provides somewhat more pressure rise than the two VA fans in series and therefore provides a further but marginal flow increase. While these approaches of using two stages in series do allow up to twice the available shaft power with the same motor diameter, the resulting change in fan performance is manifested as a large increase in pressure rise capability and a small increase in flow rate.

Although CR fans may offer certain performance advantages, the architecture of these fans presents additional challenges that may lead to increased cost, limited scalability due to motor size and customization, and reduced reliability. CR fans commonly use two motors in series, usually with both the motors and the impellers confined within a single fan housing, such as shown in FIG. 4. This typical CR fan architecture includes impellers at the front and rear of the fan, two motors located between the impellers, and a stationary motor support structure(s), also located between the two impellers. The motors are supported in a cantilevered fashion by the support structure, which attaches to both the outer diameter and the non-drive end of the motor housings.

While this construction results in an axially compact fan, it has significant limitations. A primary limitation is that the fan is only feasible for use in low power applications due to the structural support and motor cooling challenges. This fan also requires some motor customization to interface with the support structure. Industrial fan applications commonly use motors that weigh several hundred pounds, where a cantilevered support would be inadequate and a more robust support, such as shown in FIGS. 1 and 2, is required. Another limitation of the fan design of FIG. 4 is the suboptimum motor cooling resulting from the cooling fins being partially covered by the impeller hub and the motor non-drive ends being shielded from the mainstream flow. Finally, this configuration is penalized by aerodynamic losses due to swirling air that flows over the exposed motor housing fins. Thus, the construction of FIG. 4 severely restricts motor size and power, requires custom motors to interface with the support structure, compromises motor cooling, and results in additional aerodynamic losses due to swirling air flow over the exposed motor housings.

FIG. 5 shows a less common CR fan which is described in U.S. Pat. No. 8,951,012 by Santoro. This CR fan architecture employs a single motor to drive two counter-rotating impellers through the use of a transmission. As shown in FIG. 5, this approach is intended for a vertical fan orientation, although it could be adapted for a horizontal orientation. Both the motor and the transmission require support structures. In addition, this approach is subject to cost, reliability, and maintenance issues associated with the transmission.

Impedance is a term used to describe the resistance level or pressure loss characteristic of a duct system. For typical duct systems with turbulent airflow, system resistance is proportional to the dynamic head of the flow. Therefore, impedance may be defined as:

$$\text{System Impedance } I = \frac{\Delta P}{\frac{1}{2}\rho v^2}$$

where $\Delta P$ is the system pressure loss, $\rho$ is the inlet density of the air flow, and $v$ is the velocity of the air flow. Systems with low losses, such as those with short runs of smooth ductwork, can be considered low impedance systems. Systems with high losses, such as those with long and rough ducts, screens, guards, elbows, dampers, etc., can be considered high impedance systems.

TA and VA fans are commonly used in low to moderate impedance applications where $I<10$, i.e. where high flow rates and low to moderate pressure rise are required. As shown in FIGS. 1 and 2, these are single stage fans which include a motor, a motor support, an impeller, and for VA fans, an outlet guide vane assembly. A relative comparison of fan performance curves is shown in FIG. 6, which demonstrates that the VA fan achieves higher pressure rise at the same flow rate than the TA fan, and that therefore the VA fan may operate at a higher impedance.

For higher impedance applications, such as where I>10, VA fans may be stalled, and centrifugal blowers are commonly used instead. However, conventional blowers are larger and heavier than similarly powered axial fans and may not provide sufficient flow power in all applications. Size and weight are particularly important for temporary installations.

Placing two VA fans in series or using a CR fan are alternate ways to achieve a high impedance axial fan. In both cases, two motors are disposed in series and provide up to twice the available shaft power of a single fan. Placing two fans in series yields a substantial increase in pressure rise. An example performance comparison of a single VA fan, two identical VA fans in series, and a CR fan is shown in FIG. 7. As shown in FIG. 7, for applications with high system impedance, the single VA fan will be in stall and the two-in-series VA fan will be stable with good performance. The CR fan uses the same impeller as the VA fan for its first impeller, and the second impeller is designed to operate at the same speed and to draw the same shaft power as the first impeller. Similar to two VA fans in series, the CR fan also provides an increase in pressure rise. In this case, the CR fan provides somewhat more pressure rise than the two VA fans in series and therefore provides a further performance benefit at both high and low impedance. These approaches of using two stages in series result in a large increase in pressure rise capability suitable for high impedance systems. The CR architecture is preferred over the two-in-series VA architecture because it maintains a performance benefit and a size and weight advantage by virtue of not requiring the guide vane components.

Low cost fans use induction motors and fixed stagger impeller blades which yield a single performance curve that is suitable for a limited number of applications. In some cases, the fan may be offered in both TA and VA configurations (FIGS. 1 and 2) to provide two performance curve options (FIG. 6). In this example, the VA design requires the addition of a guide vane component to create the second performance curve option. In general, prior art fans with fixed stagger impellers require a new motor or a new aerodynamic component (e.g., a new impeller or a vane set) to generate an additional performance curve option. With the vast number of applications and flow requirements in the air moving universe, a large number of components must be designed and manufactured so that a suitable performance curve is available using fixed components. The need to address a multitude of performance requirements has led manufacturers to offer variable stagger impellers and variable speed motors to expand the number of performance curves that one design can deliver. However, variable speed and variable stagger features come with additional cost and complexity.

Therefore a need exists for a fan which can deliver more flow at a fixed size and rotational speed using electric motors.

Also, a need exists for a fan which is capable of operating at high impedance with a smaller size and weight than conventional blowers, with improved performance in a smaller size than two VA fans in series, and without the customization and motor power and size restrictions of conventional CR fans.

Furthermore, a need exists for a convertible fan which can provide multiple fan curve options using fewer fixed components.

SUMMARY OF THE INVENTION

In accordance with one embodiment of the present invention, a two stage axial fan is provided which comprises: a tubular fan housing; first and second motors which are positioned in series in the fan housing; a first impeller which is positioned in the fan housing and is driven by the first motor; and a second impeller which is positioned in the fan housing and is driven by the second motor; wherein the first motor is positioned on a first foot-mounted motor support structure which is connected to the fan housing and the second motor is positioned on a second foot-mounted motor support structure which is connected to the fan housing.

In accordance with one aspect of this embodiment, the first and second impellers are positioned between the first and second motors, the first impeller is positioned upstream of the second impeller, and the first and second impellers are driven by the motors so as to rotate in opposite directions.

In accordance with another aspect, the fan may comprise a flow coefficient at free air which is greater than or equal to about 0.15.

In accordance with yet another aspect, the first impeller may comprise a tip stagger angle of between about 40° and 60° and a radius ratio of less than or equal to about 0.6, and the second impeller may comprise a tip stagger angle of between about 50° and 70° and a radius ratio of less than or equal to about 0.6. For example, the first impeller may comprise a tip stagger angle of about 45°, a hub stagger angle of about 16° and a radius ratio of about 0.5, and the second impeller may comprise a tip stagger angle of about 55°, a hub stagger angle of about 46° and a radius ratio of about 0.5. The first impeller may also comprise a tip camber angle of about 23° and a hub camber angle of about 41°, and the second impeller may also comprise a tip camber angle of about 27° and a hub camber angle of about 37°. The first impeller may further comprise a midspan solidity of about 1.1 and an aspect ratio of about 1.1, and the second impeller may further comprise a midspan solidity of about 0.8 and an aspect ratio of about 1.0.

In accordance with yet another aspect, the first impeller may comprise a tip stagger angle of between about 40° and 65° and a radius ratio of between about 0.4 and 0.65, and the second impeller may comprise a tip stagger angle of between about 45° and 70° and a radius ratio of between about 0.4 and 0.65. In addition, the fan may comprise a speed ratio of between about 0.5 and 1.0. Also, the first impeller may be rotated at a first speed and the second impeller may be rotated at a second speed which is approximately 0.8 times the first speed, and the first impeller may comprise a tip stagger angle of about 58°, a hub stagger angle of about 38° and a radius ratio of about 0.65, and the second impeller may comprise a tip stagger angle of about 59°, a hub stagger angle of about 53° and a radius ratio of about 0.65. The first impeller may also comprise a tip camber angle of about 19° and a hub camber angle of about 35°, and the second impeller may also comprise a tip camber angle of about 23° and a hub camber angle of about 28°. The first impeller may further comprise a midspan solidity of about 1.0 and an aspect ratio of about 0.7, and the second impeller may further comprise a midspan solidity of about 0.9 and an aspect ratio of about 0.6.

In accordance with a further aspect, the first motor is positioned upstream of the second motor, the first impeller is positioned between the first and second motors, the second impeller is positioned downstream of the second motor, and the first and second impellers are driven by the motors so as to rotate in the same direction. In addition, the first and second impellers may each comprise a tip stagger angle of about 45°, a hub stagger angle of about 16° and a radius ratio of about 0.50.

In accordance with another embodiment of the present invention, a two stage axial fan is provided which comprises: a tubular fan housing; first and second motors which are positioned in series in the fan housing; a first impeller which is driven by the first motor; and a second impeller which is driven by the second motor; wherein the first and second impellers are positioned between the first and second motors, the first impeller is positioned upstream of the second impeller, and the first and second impellers are driven by the motors so as to rotate in opposite directions; and wherein the first impeller comprises a tip stagger angle of between about 40° and 65° and a radius ratio of between about 0.4 and 0.65, and the second impeller comprises a tip stagger angle of between about 45° and 70° and a radius ratio of between about 0.4 and 0.65.

In accordance with one aspect of this embodiment, the fan may comprise a speed ratio of between about 0.5 and 1.0.

In accordance with another aspect, the first impeller may be rotated at a first speed and the second impeller may be rotated at a second speed which is approximately 0.8 times the first speed, and the first impeller may comprises a tip stagger angle of about 58°, a hub stagger angle of about 38° and a radius ratio of about 0.65, and the second impeller may comprise a tip stagger angle of about 59°, a hub stagger angle of about 53° and a radius ratio of about 0.65. The first impeller may also comprise a tip camber angle of about 19° and a hub camber angle of about 35°, and the second impeller may also comprise a tip camber angle of about 23° and a hub camber angle of about 28°. The first impeller may comprise a midspan solidity of about 1.0 and an aspect ratio of about 0.7, and the second impeller may comprise a midspan solidity of about 0.9 and an aspect ratio of about 0.6.

In accordance with a further aspect, the fan may comprise a flow coefficient at free air which is greater than or equal to about 0.15.

In accordance with yet another aspect, the first impeller may comprise a tip stagger angle of between about 40° and 60° and a radius ratio of less than or equal to about 0.6, and the second impeller may comprise a tip stagger angle of between about 50° and 70° and a radius ratio of less than or equal to about 0.6. For example, the first impeller may comprise a tip stagger angle of about 45°, a hub stagger angle of about 16° and a radius ratio of about 0.5, and the second impeller may comprise a tip stagger angle of between about 55°, a hub stagger angle of about 46° and a radius ratio of about 0.5. The first impeller may also comprise a tip camber angle of about 23° and a hub camber angle of about 41°, and the second impeller may also comprises a tip camber angle of about 27° and a hub camber angle of about 37°. In addition, the first impeller may comprise a midspan solidity of about 1.1 and an aspect ratio of about 1.1, and the second impeller may comprise a midspan solidity of about 0.8 and an aspect ratio of about 1.0.

The present invention also provides a system of fan components which are configurable to create a plurality of individual axial fans, the system comprising: a first axial fan which comprises a first tubular fan housing, a first motor which is positioned in the first fan housing, and a first impeller which is positioned in the first fan housing and is driven by the first motor; and a second axial fan which comprises a second tubular fan housing, a second motor which is positioned in the second fan housing, and a second impeller which is positioned in the second fan housing and is driven by the second motor; wherein the first and second axial fans are useable independently of each other; and wherein the first and second fan housings are connectable such that the first and second motors are positioned in series and the first and second impellers are positioned between the first and second motors with the first impeller positioned upstream of the second impeller, the first and second impellers being driven by the motors to rotate in opposite directions to thereby form a two-stage counter-rotating (CR) axial fan. Accordingly, the system is configurable to create at least three axial fans.

In accordance with one aspect, each of the first and second axial fans may comprise a tube-axial (TA) fan.

In accordance with another aspect, the system further comprises a reversible vane component which includes: a hub, an outer ring, a plurality of guide vanes which extend radially between the hub and the outer ring, and opposite first and second ends; wherein the vane component is configured such that when the first end is positioned upstream of the second end the vane component functions as an outlet guide vane (OGV), and when the second end is positioned upstream of the first end the vane component functions as an inlet guide vane (IGV).

In accordance with yet another aspect, the first end of the outer ring may be configured to be connectable to a downstream end of the first axial fan to thereby form a vane-axial (VA) fan. Additionally or alternatively, the first end of the outer ring may be configured to be connectable to an upstream end of the second axial fan to thereby form an inlet guide vane (IGV) fan.

In accordance with a further embodiment of the present invention, a two stage axial fan is provided which comprises: a tubular fan housing; a first impeller which is positioned in the fan housing and is driven by a first motor; and a second impeller which is positioned in the fan housing and is driven by a second motor; wherein the first and second impellers are driven by the motors so as to rotate in opposite directions; and wherein the fan comprises a flow coefficient at free air which is greater than or equal to about 0.15.

In accordance with one aspect of this embodiment, the first impeller may comprise a tip stagger angle of between about 40° and 60° and a radius ratio of less than or equal to about 0.6, and the second impeller may comprise a tip stagger angle of between about 50° and 70° and a radius ratio of less than or equal to about 0.6. For example, the first impeller may comprise a tip stagger angle of about 45°, a hub stagger angle of about 16° and a radius ratio of about 0.5, and the second impeller may comprise a tip stagger angle of about 55°, a hub stagger angle of about 46° and a radius ratio of about 0.5. The first impeller may also comprise a tip camber angle of about 23° and a hub camber angle of about 41°, and the second impeller may comprise a tip camber angle of about 27° and a hub camber angle of about 37°. The first impeller may further comprise a midspan solidity of about 1.1 and an aspect ratio of about 1.1, and the second impeller may further comprise a midspan solidity of about 0.8 and an aspect ratio of about 1.0.

In accordance with still another embodiment of the present invention, a two stage axial fan is provided which comprises: a tubular fan housing; a first impeller which is positioned in the fan housing and is driven by a first motor; and a second impeller which is positioned in the fan housing and is driven by a second motor; wherein the first and second impellers are driven by the motors so as to rotate in opposite directions; and wherein the first impeller comprises a tip stagger angle of between about 40° and 65° and a radius ratio of between about 0.4 and 0.65, and wherein the second impeller comprises a tip stagger angle of between about 45° and 70° and a radius ratio of between about 0.4 and 0.65.

In accordance with one aspect of this embodiment, the first and second impellers may be driven by the motors to rotate in the same direction, and each of the first and second impellers may comprise a tip stagger angle of about 45°, a hub stagger angle of about 16° and a radius ratio of about 0.50.

In accordance with another aspect, the first and second impellers may be driven by the motors to rotate in opposite directions. Also, the first impeller may be rotated at a first speed and the second impeller may rotated at a second speed which is approximately 0.8 times the first speed, the first impeller may comprise a tip stagger angle of about 58°, a hub stagger angle of about 38° and a radius ratio of about 0.65, and the second impeller may comprise a tip stagger angle of about 59°, a hub stagger angle of about 53° and a radius ratio of about 0.65. The first impeller may also comprise a tip camber angle of about 19° and a hub camber angle of about 35°, and the second impeller may also comprise a tip camber angle of about 23° and a hub camber angle of about 28°. Furthermore, the first impeller may comprise a midspan solidity of about 1.0 and an aspect ratio of about 0.7, and the second impeller may comprise a midspan solidity of about 0.9 and an aspect ratio of about 0.6.

In accordance with a further embodiment of the present invention, a system of fan components which are configurable to create a plurality of individual axial fans is provided which comprises: a first axial fan which comprises a first tubular fan housing and a first impeller which is positioned in the first fan housing and is driven by a first motor; and a second axial fan which comprises a second tubular fan housing and a second impeller which is positioned in the second fan housing and is driven by a second motor; wherein the first and second axial fans are useable independently of each other; and wherein the first and second fan housings are connectable such that the first and second impellers are positioned coaxially with the first impeller positioned upstream of the second impeller, the first and second impellers being driven by the motors to rotate in opposite directions to thereby define a two-stage counter-rotating (CR) axial fan. Accordingly, the system is configurable to create at least three axial fans.

In accordance with one aspect of this embodiment, each of the first and second axial fans comprises a tube-axial (TA) fan.

In accordance with another aspect, the system may also comprise a reversible vane component which comprises: a hub, an outer ring, a plurality of guide vanes which extend radially between the hub and the outer ring, and opposite first and second ends; wherein the vane component is configured such that when the first end is positioned upstream of the second end the vane component functions as an outlet guide vane (OGV), and when the second end is positioned upstream of the first end the vane component functions as an inlet guide vane (IGV).

In accordance with yet another aspect, the first end of the outer ring may be configured to be connectable to a downstream end of the first axial fan to thereby form a vane-axial (VA) fan. In addition or alternatively, the first end of the outer ring may be configured to be connectable to an upstream end of the second axial fan to thereby form an inlet guide vane (IGV) fan.

The present invention has applicability to a variety of fans, including, e.g., industrial fans driven by electric motors with input power levels typically greater than 500 W. In a first embodiment, the invention provides a two stage fan which is capable of generating higher flow rates than conventional fans at the same size and rotational speed. In this embodiment, the fan comprises two impellers which are disposed in series and are configured to generate high flow rather than high pressure. Individual stage characteristics are unique, with negative static pressure rise over much of the fan operating range. Each impeller alone would have limited utility as a single stage fan because of its low pressure rise capability and its narrow stable operating range. However, combining two such impellers in series yields a two-stage fan that has a high flow rate and a large operating range. The impellers feature low-stagger blades, and the hub-to-tip radius ratio is lower than a single stage fan with similar shaft power. The invention may be used in industrial fans, which are typically driven by electric motors, usually AC induction motors, and are configured either as direct-drive or belt-drive systems.

Thus, this embodiment of the invention addresses the numerous problems associated with prior art fans by:

1) enabling the use of two electric motors in series to increase the shaft power available without increasing motor diameter;
2) providing an aerodynamic configuration of two impeller stages that converts the shaft power from two motors in series primarily into flow rather than pressure by employing individual stage characteristics with negative pressure rise over much of the operating range;
3) providing a CR architecture in which the impellers are located between the motors and motor supports, and in which the motor supports are conventional foot-mounted motor support structures that are adaptable to virtually any motor size and power; and
4) improving on the CR architecture motor cooling approach by fully exposing the motor housings to a predominantly axial airflow which is aligned with the motor cooling fins and by using impellers as additional heat sinks to cool the motor drive ends, which are not directly exposed to the mainstream flow.

In accordance with another embodiment, the present invention is directed to an axial fan which is capable of achieving high impedance with smaller size and weight compared to centrifugal blowers, which has improved performance and a smaller size than two VA fans in series, and which does not have the customization and motor power and size restrictions of conventional CR fans.

In accordance with a further embodiment, the invention is directed to a system of fan components which can be arranged in different combinations to create a plurality of axial fans having multiple performance characteristics. In contrast to this arrangement, prior art fans that use an AC induction motor with a fixed-stagger impeller require an additional or different component to generate a different performance characteristic. Using the same low cost components and construction, the system of the present invention provides multi-characteristic options which enable a few components to address a wide variety of performance requirements.

These and other objects and advantages of the present invention will be made apparent from the following detailed description with reference to the accompanying drawings. In the drawings, the same reference numbers are used to denote similar components in the various embodiments.

DETAILED DESCRIPTION OF THE INVENTION

The present invention is applicable to both co-rotating and counter-rotating fans. Nevertheless, a person of ordinary skill in the art will readily appreciate how the teachings of the present invention can be applied to other types of fans. Therefore, the following description should not be construed to limit the scope of the present invention in any manner.

Figure 1:
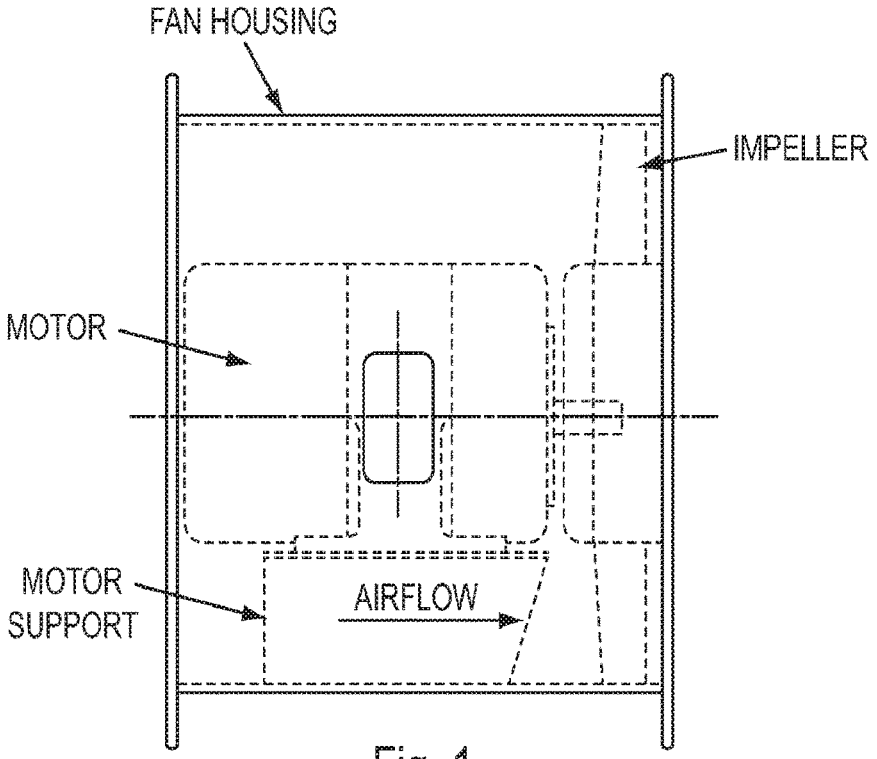
FIG. 1 is a side elevation representation of a prior art tube-axial fan.
Figure 2:
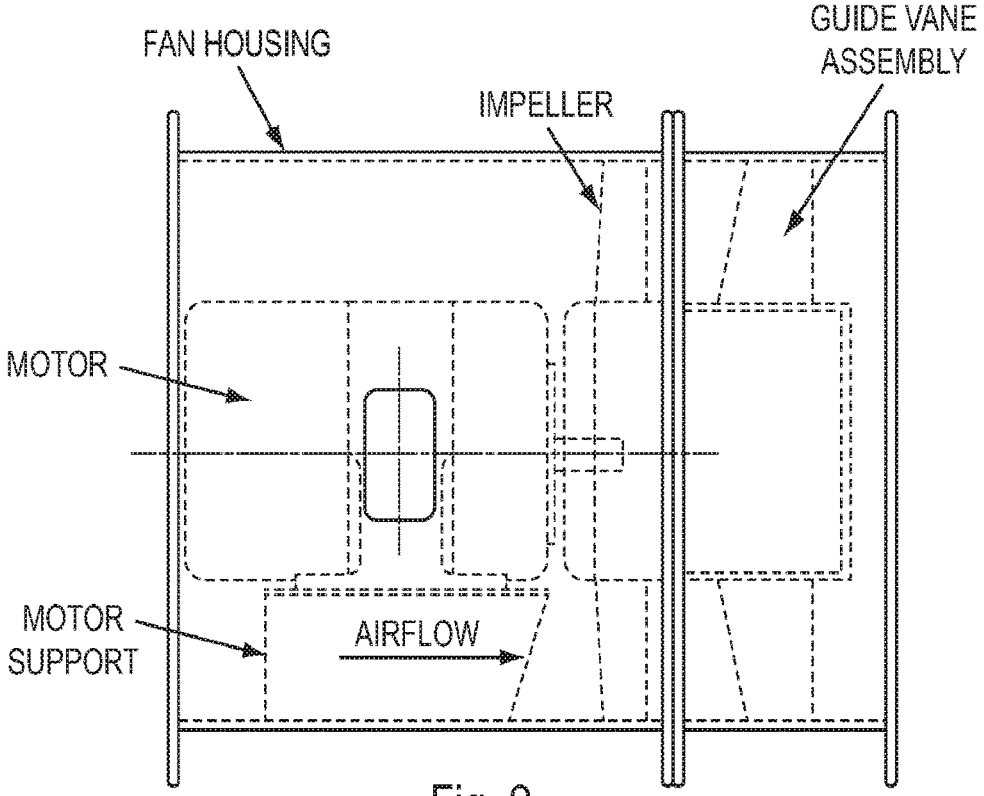
FIG. 2 is a side elevation representation of a prior art vane-axial fan.
Figure 3:
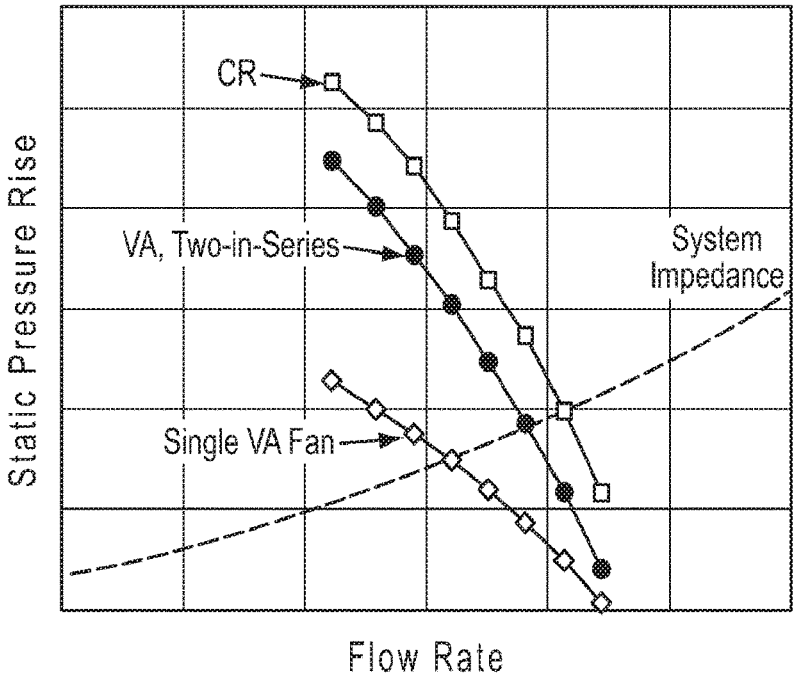
FIG. 3 is a graph comparing the performance of a single vane-axial fan, two vane-axial fans in series and a counter-rotating fan.
Figure 4:
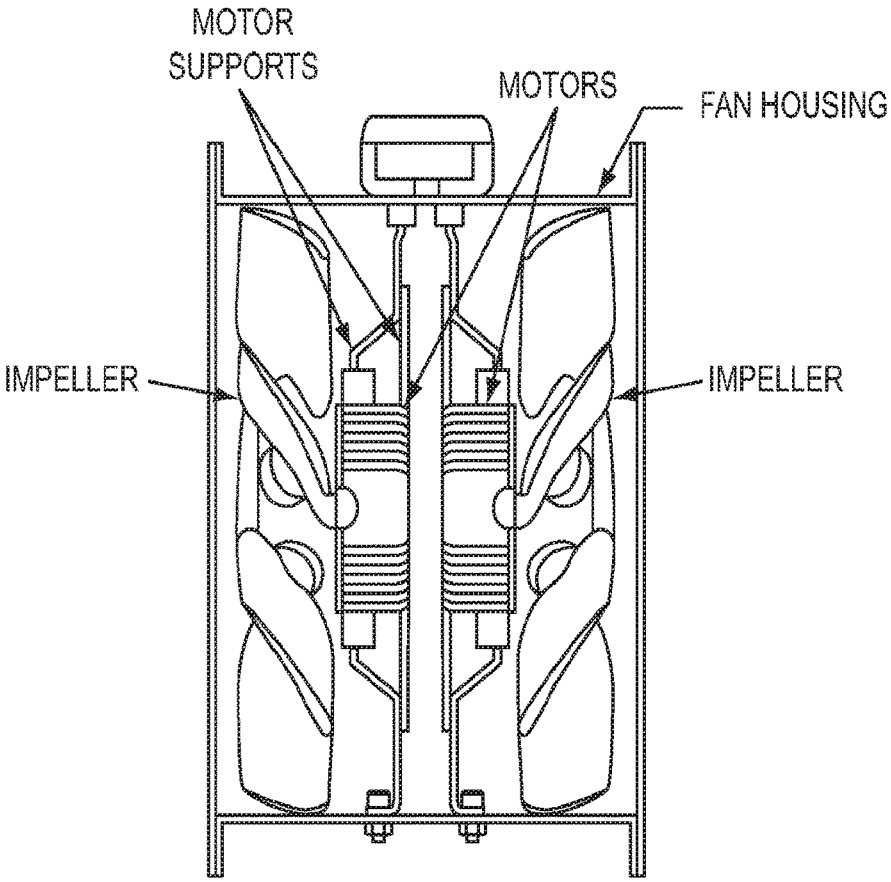
FIG. 4 is a side elevation representation of a prior art counter-rotating fan with cantilevered motors.
Figure 5:
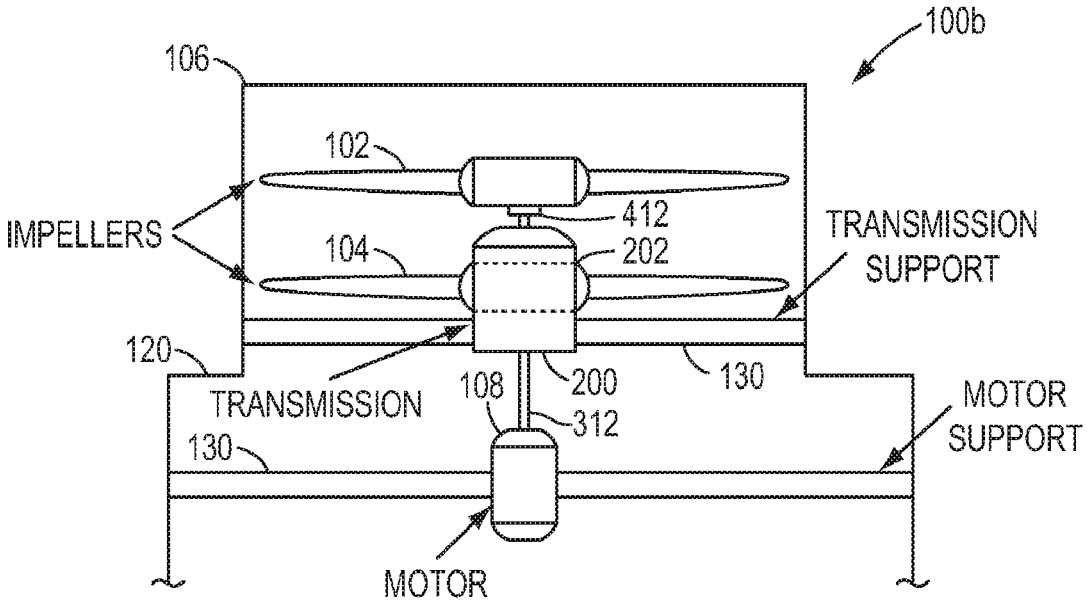
FIG. 5 is a side elevation representation of a prior art counter-rotating fan having a transmission for driving both impellers with a single motor.
Figure 6:
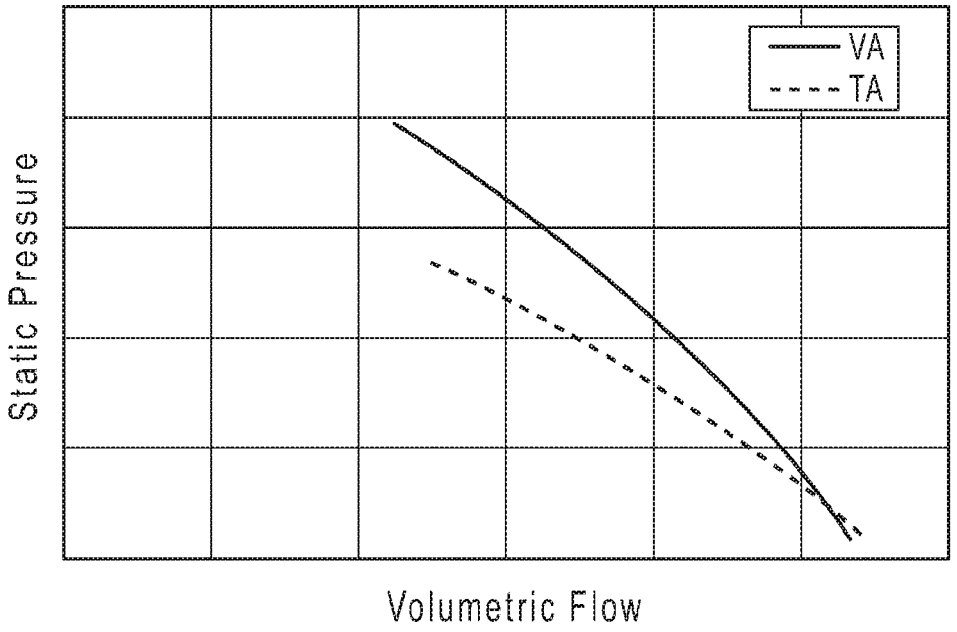
FIG. 6 is a graph comparing the performance of a tube-axial fan and vane-axial fan.
Figure 7:
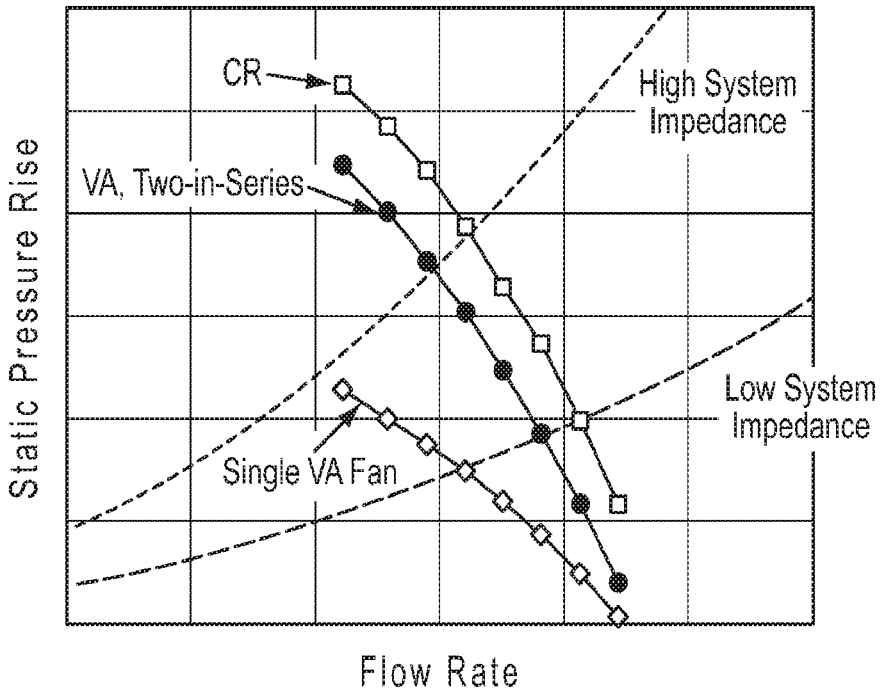
FIG. 7 is a graph, similar to FIG. 3, comparing the performance of a single vane-axial fan, two vane-axial fans in series and a counter-rotating fan.
Figure 8:
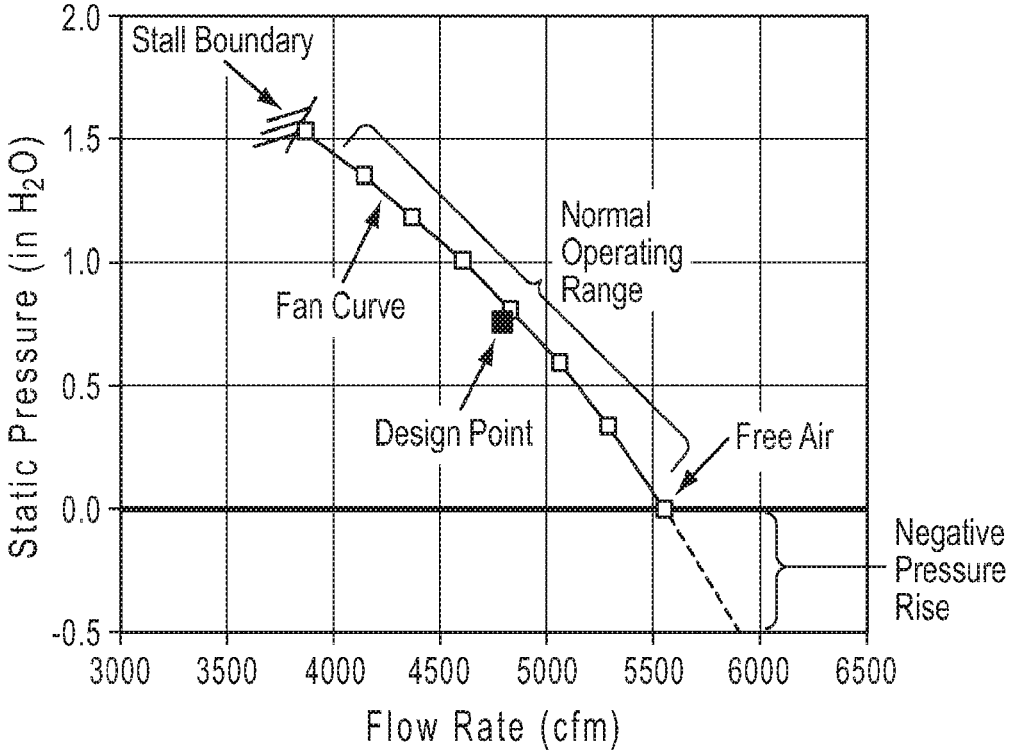
FIG. 8 is a graph showing an example of a fan performance curve.

Referring to FIG. 8, fan performance can be described using a graph of static pressure rise vs. airflow, where static pressure rise is defined as the exit static pressure minus the inlet total pressure of the fan. A design point established early in the design phase is the performance target to be achieved for the fan, and this target is used as an operating point for conducting design analysis and optimization. It is common for the stall boundary for a fan to occur at a flow at least 20% lower than the design point flow rate. The fan performance curve of FIG. 8 represents fan performance at various back pressure conditions. The normal operating range of the fan, which is indicated by the solid line, exists between zero static pressure rise, also known as free-air, and the stall boundary. As a result, only the solid line portion of the fan curve represents fan performance. The region beyond free-air having negative pressure rise, which is represented in FIG. 8 by the dashed line, is not a physically realistic operating region for an isolated fan.

In accordance with the present invention, two impellers that are optimized for design points in the negative pressure rise region are combined in series to achieve a two stage fan which is capable of achieving high flow rates and possesses a broad operating range.

Figure 9:
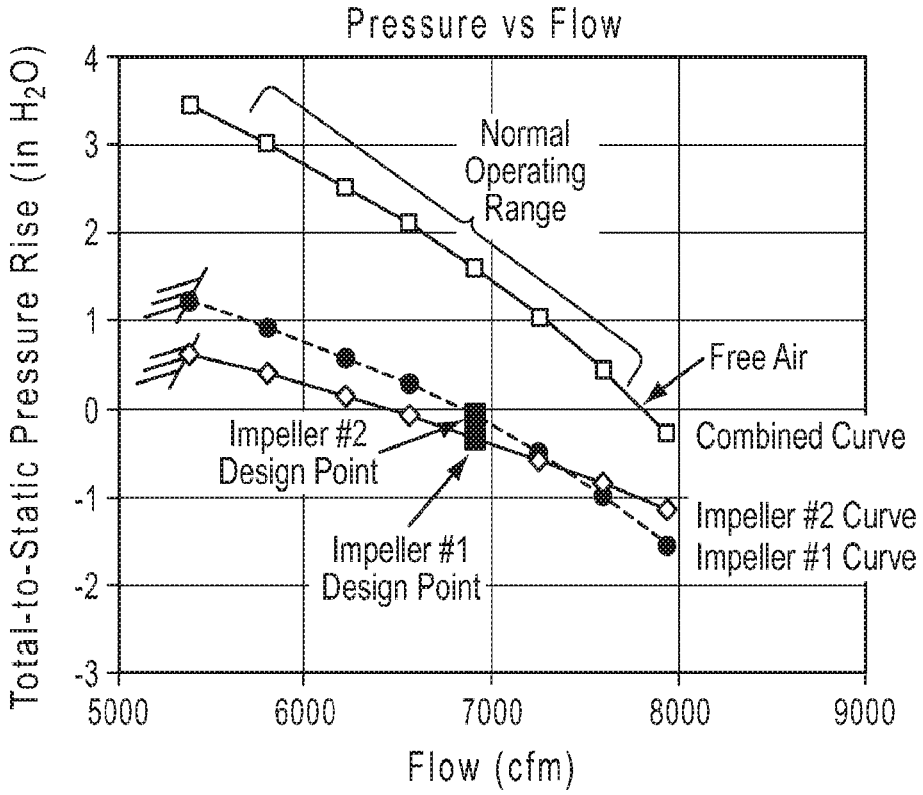
FIG. 9 is a graph showing an example of a fan performance curve for an embodiment of the fan of the present invention.

An example performance graph for an 18 inch diameter CR fan which embodies the principles of the present invention is shown in FIG. 9. In this example, both impellers have design points located in the negative static pressure rise region, with their respective stall boundaries located approximately 20% lower than the design point flow, and with much of their individual performance curves residing in the negative pressure rise region. As shown in FIG. 9, the performance of each impeller is defined with respect to its inlet total pressure, so that the inlet total pressure of impeller #2 corresponds to the exit total pressure of impeller #1. As may be seen, while the individual performance curves have a narrow range of operation with positive pressure rise, the combined curve enjoys a large operating range with a high flow rate and positive pressure rise.

Figure 10:
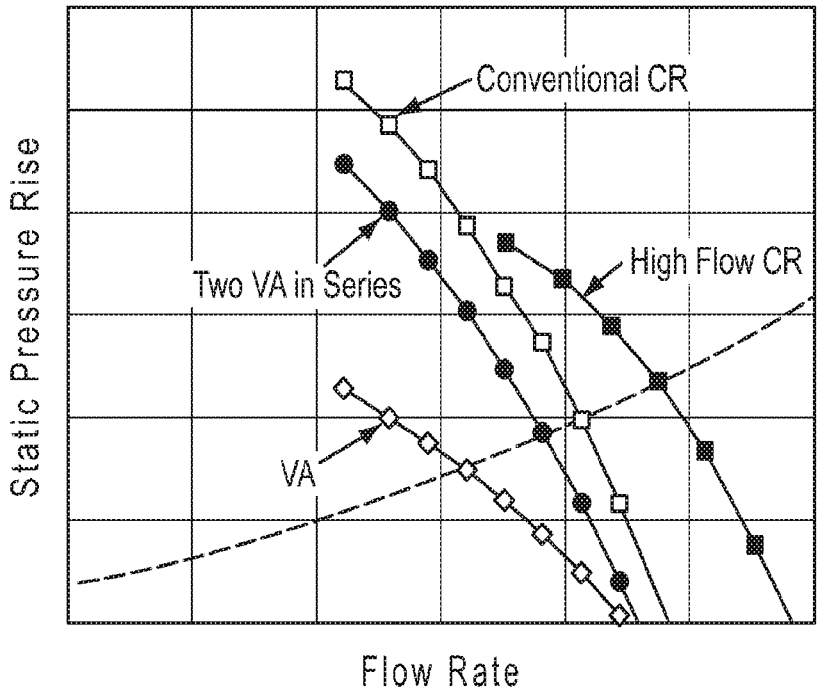
FIG. 10 is a graph showing the flow advantage of an embodiment of the fan of the present invention by comparing conventional two stage fans with a high flow counter-rotating fan.

The flow advantage obtained by designing a two stage fan with the design points of both impellers in the negative pressure rise region is demonstrated in FIG. 10. In this figure the "High Flow CR" curve represents a design based on the present invention which uses the same motors as the other represented designs. As is evident from FIG. 10, the present invention provides a substantial increase in flow compared to conventional two-stage designs, particularly for low impedance applications.

Impellers designed in accordance with the present invention feature low stagger angles and low to moderate radius ratios. Suitable values for such parameters are set forth in Table 1 below. In Table 1, the flow coefficient is a performance parameter which will be defined below.

TABLE 1

Impeller Geometry Ranges

| Impeller # | Tip Stagger | Radius Ratio | Flow Coefficient at Free Air |
|---|---|---|---|
| 1 | 40°-60° | ≤0.6 | ≥0.15 |
| 2 | 50°-70° | ≤0.6 | ≥0.15 |

The impellers of one embodiment of the present invention comprise the stagger angles and radius ratios shown in Table 2. The stagger angle is defined as the angle between the chord line and the axial direction, and the radius ratio is defined as the blade hub radius divided by the blade tip radius. As will be apparent, the specific stagger angles referred to herein are listed as absolute values. A broad array of solidity and aspect ratio may be suitable depending on the performance targets. Example values of impeller solidity and aspect ratio for the impellers of this embodiment are also specified in Table 2. Midspan solidity is defined as the chord divided by the tangential spacing between blades at midspan. Aspect ratio is defined as the blade height divided by the chord.

TABLE 2

Example Impeller Geometry

| Impeller # | Tip/Hub Stagger | Tip/Hub Camber | Radius Ratio | Midspan Solidity | Aspect Ratio |
|---|---|---|---|---|---|
| 1 | 45°/16° | 23°/41° | 0.5 | 1.1 | 1.1 |
| 2 | 55°/46° | 27°/37° | 0.5 | 0.8 | 1.0 |

Figure 10A:
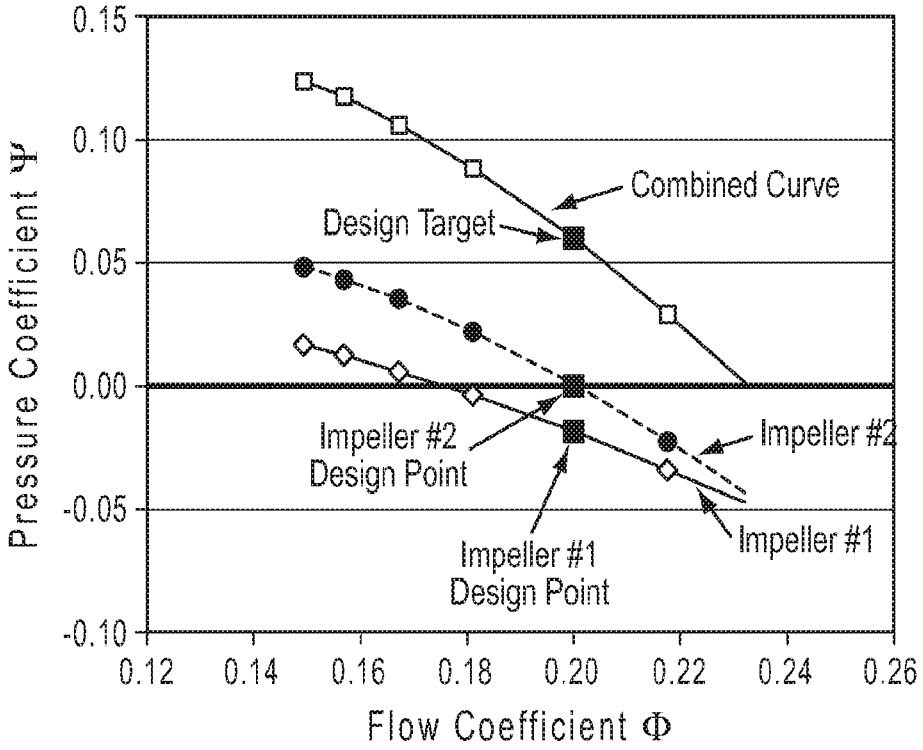
FIG. 10A is a graph showing the performance of the fan represented in Table 1 in terms of flow coefficient and pressure coefficient.

The resulting performance of the fan represented in Table 2 is shown in FIG. 10A in terms of the dimensionless global duty parameters of flow coefficient and pressure coefficient. These dimensionless parameters, which enable a convenient way to compare overall aerodynamic performance among fans that accounts for differences in fan size and speed, are defined as follows:

$$\text{Flow Coefficient } \Phi = \frac{Q}{ND^3}$$

$$\text{Pressure Coefficient } \Psi = \frac{\Delta P}{\rho N^2 D^2}$$

where Q is the volumetric flow rate, N is the rotational speed of the first impeller, D is the tip diameter of the impellers, ΔP is the total-to-static pressure rise, and ρ is the inlet density of the air flow. In this regard, it should be noted that although the rotational speed of the second impeller need not be the same as that of the first impeller, the present invention contemplates that the rotational speed of the second impeller is approximately the same as or less than that of the first impeller.

As shown by the combined curve in FIG. 10A, the fan achieves a flow coefficient of approximately 0.23 in free air. To achieve the design target, both impeller design points have a pressure rise which is near zero or negative, and each impeller operates with negative static pressure rise over much of the normal operating range.

Figure 11:
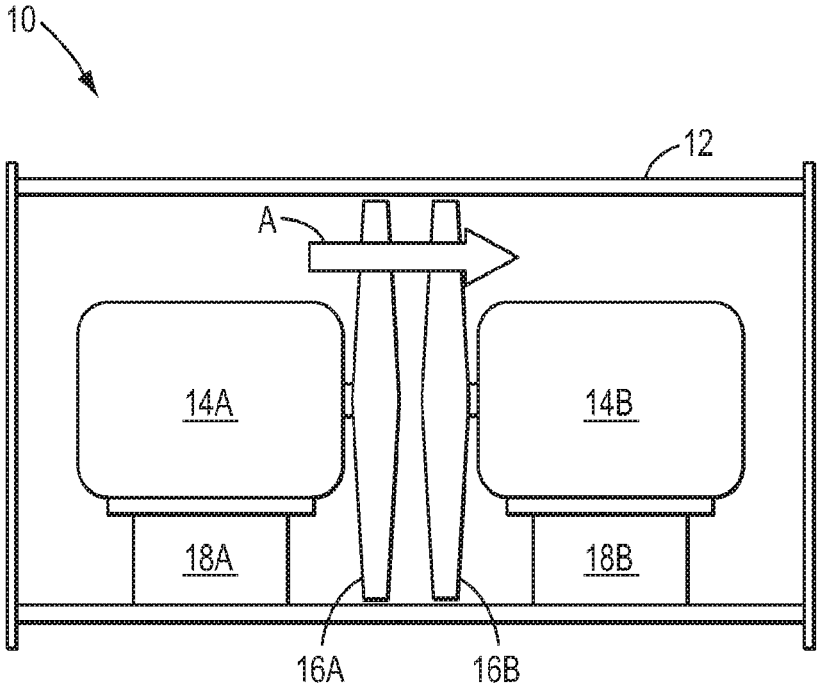
FIG. 11 is a side elevation representation of one embodiment of the fan of the present invention.

FIG. 11 is a representation of one embodiment of a CR fan of the present invention. The two stage fan of this embodiment, generally 10, is shown to comprise a tubular fan housing 12, two electric motors 14A, 14B which are positioned in series in the fan housing, and two impellers 16A, 16B which are each connected to a corresponding motor. Each motor 14A, 14B is supported on a respective motor support 18A, 18B which is connected to the fan housing 12. The motors 14A, 14B are placed in series to thereby provide more available shaft power to the impellers 16A, 16B compared to a single motor of the same diameter. The motor supports 18A, 18B may be, e.g., conventional foot-mounted motor support structures, which not only provide a robust support for the motors 14A, 14B, but also are able to accept many different standard motor frame sizes. The impellers 16A, 16B are located between the motors 14A, 14B and rotate in opposite directions. This arrangement improves motor cooling by fully exposing the motor housings to a predominantly axial mainstream airflow (indicated by arrow A) which is aligned with the motor cooling fins. In addition, the impellers 16A, 16B act as additional heat sinks to cool the motor drive ends, which as shown in FIG. 11 are not directly exposed to the mainstream airflow A. Maintaining a similar torque for the two impellers contributes to improved performance. By maintaining a similar torque, the swirl generated by the first impeller is removed by the second impeller, resulting in low exit swirl. Low exit swirl helps to minimize pressure losses from the downstream motor and motor supports.

Figure 12:
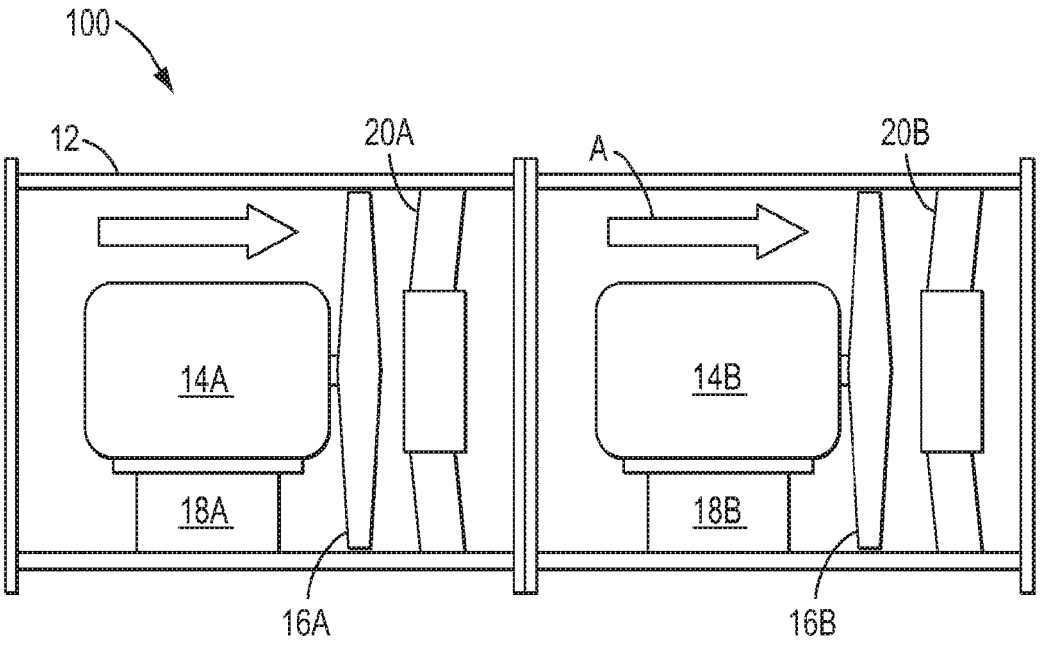
FIG. 12 is a side elevation representation of another embodiment of the fan of the present invention.

Referring to FIG. 12, the present invention may also be applied to a two stage co-rotating fan. The two stage fan of this embodiment, generally 100, includes a tubular fan housing 12, two electric motors 14A, 14B which are positioned in series in the fan housing, two impellers 16A, 16B which are each connected to a corresponding motor, and two guide vane assemblies 20A, 20B which are each positioned downstream of a corresponding impeller. As in the previous embodiment, each motor 14A, 14B is supported on a respective motor support 18A, 18B which is connected to the fan housing 12. In contrast to the previous embodiment, however, only the first impeller 16A is located between the motors 14A, 14B. In addition, the impellers 16A, 16B rotate in the same direction. Thus, the fan 100 is similar to an assembly of two vane-axial fans in series. However, the individual stage and combined performance of the fan 100 are similar to that described in FIG. 9 for the CR fan example. Likewise, the impeller stagger angles and radius ratios are similar to those of impeller #1 defined in Table 2.

To take advantage of the additional shaft power available from the CR fan design shown in FIG. 11, the impellers may be configured to generate high flow rates, as described above, or to operate at high impedance, such as with a stall impedance 15. Table 3 specifies representative ranges of tip stagger and radius ratio which are applicable to both impeller configurations. High flow configurations feature stagger angles and radius ratios at the lower end of the range. High impedance configurations will generally feature radius ratios and/or stagger angles at the higher end of the range.

TABLE 3

Impeller Geometry Ranges

| Impeller # | Tip Stagger | Radius Ratio |
|---|---|---|
| 1 | 40°-65° | 0.4-0.65 |
| 2 | 45°-70° | 0.4-0.65 |

Especially for high impedance configurations, designing the second stage to operate at a lower speed than the first stage contributes to improved performance. Designing for lower speed reduces the required blade stagger angles and inlet relative velocity, both of which may become excessively high for the second stage and penalize aerodynamic performance. The speed ratio may be defined as follows:

$$\text{Speed Ratio} = \frac{N2}{N1}$$

where N2 is the stage 2 rotational speed and N1 is the stage 1 rotational speed. For variable speed fans, this ratio may be controlled and modified during operation. For fixed speed fans, such as a direct drive fan using AC induction motors without variable frequency drives, the speed ratio remains approximately constant during operation and is determined by the respective motor pole counts. A suitable range for the speed ratio is approximately 0.5-1.0.

The impellers of one embodiment of the high impedance configuration comprise the speed ratio, stagger angles, and radius ratios shown in Table 4. A broad array of solidity and aspect ratio may be suitable depending on the performance targets. Example values of impeller midspan solidity and aspect ratio for the impellers of this embodiment are also specified in Table 4.

TABLE 4

Example Impeller Geometry

| Impeller # | Rotational Speed | Tip/Hub Stagger | Tip/Hub Camber | Radius Ratio | Midspan Solidity | Aspect Ratio |
|---|---|---|---|---|---|---|
| 1 | N1 | 58°/38° | 19°/35° | 0.65 | 1.0 | 0.7 |
| 2 | 0.8 * N1 | 59°/53° | 23°/28° | 0.65 | 0.9 | 0.6 |

Figure 13A:
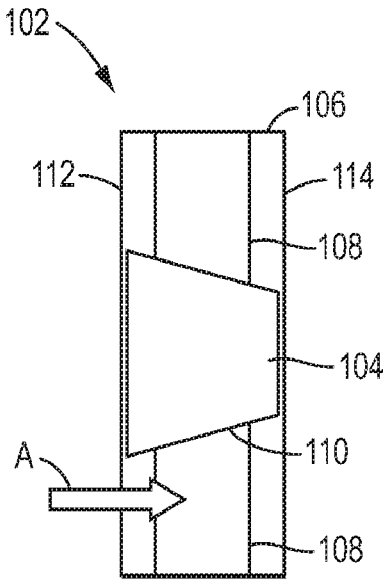
FIGS. 13A and 13B are side elevation representations of a reversible vane component which in FIG. 13A is oriented to function as an outlet guide vane and in FIG. 13B is oriented to function an inlet guide vane
Figure 13B:
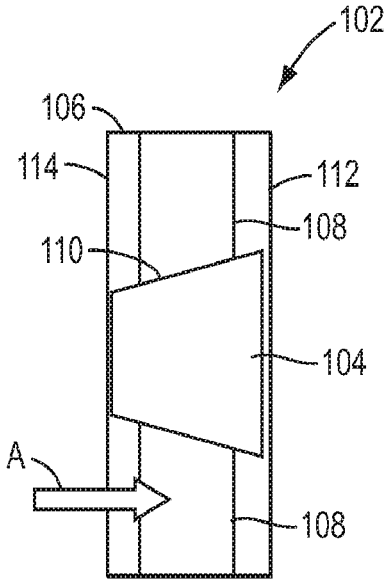

When configured for high flow rates, each stage has a low pressure rise and would therefore have limited utility as a single stage. However, when configured for high impedance, the two-stage fan impellers are useful as single stage TA fans. The impellers may also be used in combination with an outlet guide vane (OGV)/inlet guide vane (IGV) component, such as shown in FIGS. 13A and 13B, to thereby form VA and IGV fans, respectively. FIGS. 13A and 13B depict a reversible vane component, generally 102, which comprises a hub 104, an outer ring 106, and a plurality of guide vanes 108 that extend radially between the hub and the outer ring. As shown in FIGS. 13A and 13B, the hub 104 may comprise an outer diameter surface 110 which converges from a first side 112 of the vane component 102 to a second side 114 of the vane component.

The reversible vane component 102 is a single fan component which functions as an OGV in one orientation and as an IGV in the reverse orientation. In FIG. 13A the vane component 102 is oriented as an OGV which is normally positioned downstream of the impeller. In this orientation, the first side 112 defines the upstream end of the vane component 102 and the second side 114 defines the downstream end of the vane component. In this regard, the terms "upstream" and "downstream" are defined relative to the direction of airflow through the vane component 102, which is depicted by the arrow A. In FIG. 13B the vane component 102 is oriented as an IGV which is normally positioned upstream of the impeller. In this orientation, the second side 114 defines the upstream end of the vane component 102 and the first side 112 defines the downstream end of the vane component.

In accordance with the present invention, a system of fan components is provided which may be configured to create a plurality of individual axial fans. Such a system offers versatility to address a wide range of fan applications using a few components. For example, FIG. 14 demonstrates how one system of fan components may be configured to form a plurality of fans. In this example, the system of fan components, generally 116, comprises a first TA fan 118, a second TA fan 120, and a reversible vane component 102. Each TA fan 118, 120 comprises a tubular fan housing 12A, 12B, an electric motor 14A, 14B which is positioned in the fan housing, an impeller 16A, 16B which is connected to the motor, and a motor support 18A, 18B on which the motor is supported.

Figure 14:
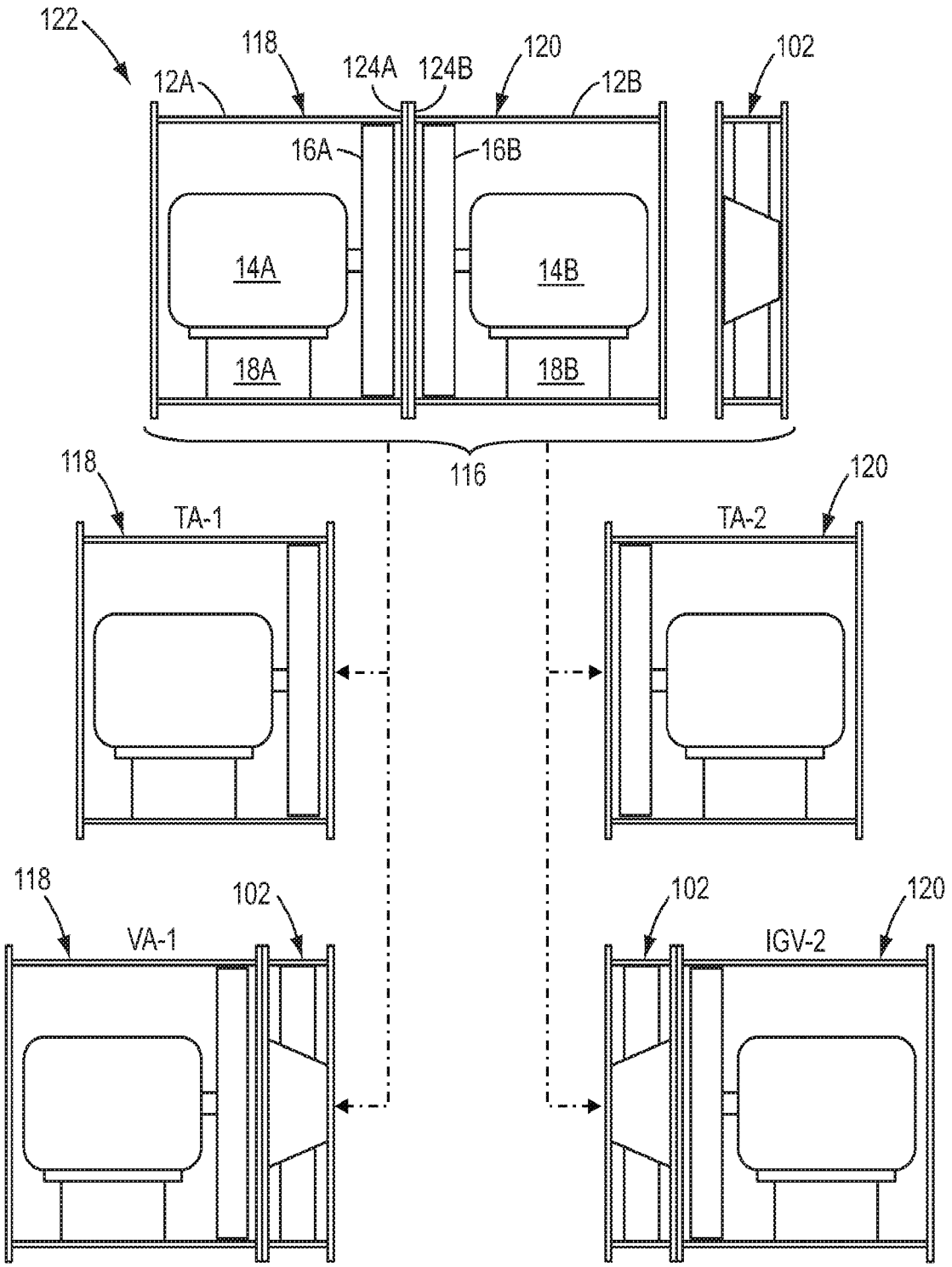
FIG. 14 is a representation of an axial fan system which can be configured to create a plurality of individual axial fans.

In one configuration of the system 116, the first and second TA fans 118, 120 are connected together to form a two-stage CR fan 122. If as shown in FIG. 14 the housings 12A, 12B comprise end flanges 124A, 124B, the TA fans 118, 120 may be connected together by bolting the adjacent end flanges together.

In another configuration of the system 116, the first TA fan 118 may be used by itself a single-stage tube-axial fan TA-1. The first TA fan 118 may also be combined with the vane component 102 (oriented as an OGV) to form a single-stage vane-axial fan VA-1. Similarly, the second TA fan 120 may be used by itself as a single-stage tube axial fan TA-2 or combined with the vane component 102 (oriented as an IGV) to create a single-stage inlet guide vane fan IGV-2.

Thus, the system 116, which comprises three fan components, may be configured to form up to five different fans. The two-stage CR fan 122 has the greatest axial length and input power requirement. TA-1 and TA-2 have the smallest axial length and are the lowest cost. VA-1 and IGV-2 have intermediate axial lengths and offer improved performance relative to TA-1 and TA-2.

Figure 15:
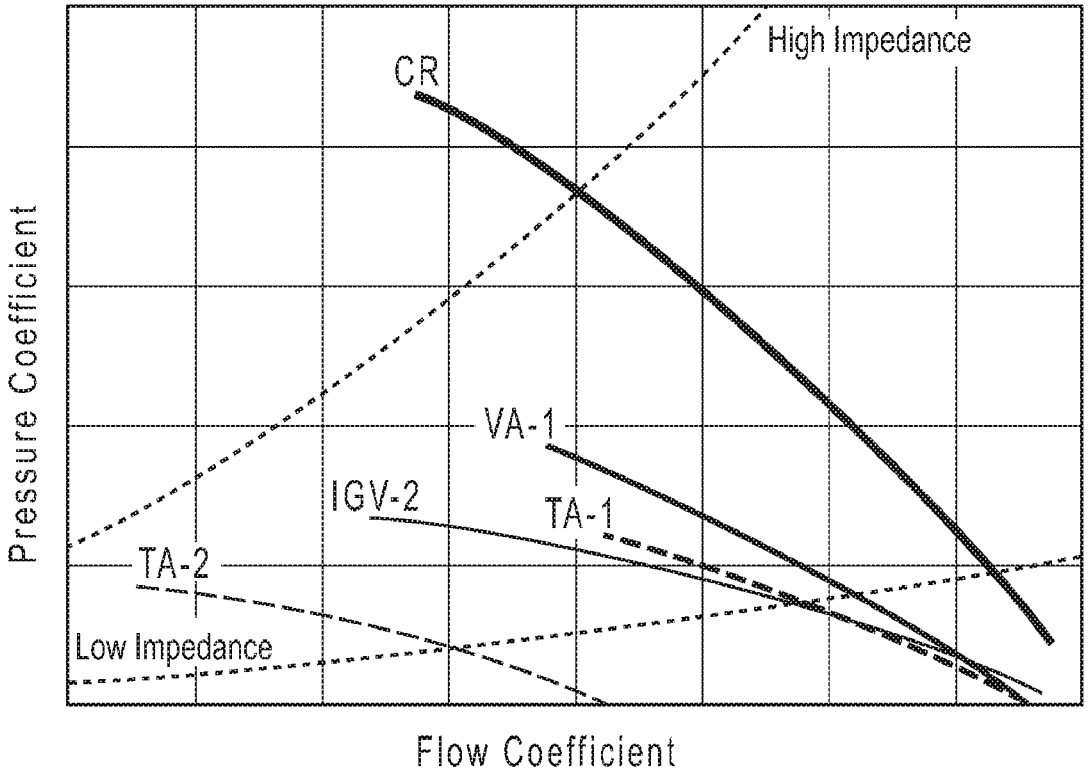
FIG. 15 is a graph showing the performance of the axial fans depicted in FIG. 14 in terms of flow coefficient and pressure coefficient.

FIG. 15 is a relative performance comparison of the various fan created from the system of fan components 116. The CR fan 122 has the highest performance and is suitable for high impedance applications. TA-1 is suitable for low impedance applications and VA-1, TA-2, and IGV-2 are appropriate for moderate impedance applications. Of the single stage fans, VA-1 provides the highest performance, while IGV-2 provides slightly less performance but with additional throttling range. TA-2 provides the lowest performance of the group but is also capable of throttling to moderate impedance. Each fan has different performance characteristics, length, weight, and cost attributes to enable a variety of fan options suitable for applications with differing requirements and constraints.

The reversible vane component 102 may be a simple, low cost design with a circular arc profile that is uniform from hub-to-tip. In the OGV configuration, the trailing edge meanline angle will preferably be near 0 degrees, which leads to good performance in the IGV configuration by minimizing incidence losses. The vane camber level should be consistent with the VA throttling range required, and the vane solidity level should be sufficient for the camber level to achieve good performance. Table 5 lists the characteristics of a reversible vane component which is suitable for use with the impellers represented in Table 4.

TABLE 5

Reversible Vane Geometry

| Tip/Hub Stagger | Tip/Hub Camber | Radius Ratio | Mid-span Solidity | Aspect Ratio |
|---|---|---|---|---|
| 20°/20° | 40°/40° | 0.65 | 1.4 | 0.4 |

It should be recognized that, while the present invention has been described in relation to the preferred embodiments thereof, those skilled in the art may develop a wide variation of structural and operational details without departing from the principles of the invention. For example, various features of the different embodiments may be combined in a manner not described herein. Therefore, the appended claims should be construed to cover all equivalents falling within the true scope and spirit of the invention.

What is claimed is:

1. A two stage axial fan which comprises:

a tubular fan housing;

a first impeller which is positioned in the fan housing and is driven by a first motor; and a second impeller which is positioned in the fan housing and is driven by a second motor;

wherein the first and second impellers are positioned coaxially and the first impeller is positioned upstream of the second impeller;

wherein the first impeller comprises a tip stagger angle of between 40° and 65° and a radius ratio of between 0.4 and 0.65, and wherein the second impeller comprises a tip stagger angle of between 45° and 70° and a radius ratio of between 0.4 and 0.65; and wherein the first and second impellers are driven by the motors to rotate in opposite directions.

2. The two-stage axial fan of claim 1, wherein each of the first and second impellers comprises a tip stagger angle of 45°, a hub stagger angle of 16° and a radius ratio of 0.50.

3. The two-stage axial fan of claim 1, wherein the first impeller is rotated at a first speed and the second impeller is rotated at a second speed which is 0.8 times the first speed, and wherein the first impeller comprises a tip stagger angle of 58°, a hub stagger angle of 38° and a radius ratio of 0.65, and the second impeller comprises a tip stagger angle of 59°, a hub stagger angle of 53° and a radius ratio of 0.65.

4. The two-stage axial fan of claim 3, wherein the first impeller comprises a tip camber angle of 19° and a hub camber angle of 35°, and wherein the second impeller comprises a tip camber angle of 23° and a hub camber angle of 28°.

5. The two-stage axial fan of claim 4, wherein the first impeller comprises a midspan solidity of 1.0 and an aspect ratio of 0.7, and wherein the second impeller comprises a midspan solidity of 0.9 and an aspect ratio of 0.6.

6. The two-stage axial fan of claim 1, wherein the first impeller comprises a tip stagger angle of between 40° and 60° and a radius ratio of between 0.4 and 0.6, and wherein the second impeller comprises a tip stagger angle of between 50° and 70° and a radius ratio of between 0.4 and 0.6.

7. The two-stage axial fan of claim 6, wherein the first impeller comprises a tip stagger angle of 45°, a hub stagger angle of 16° and a radius ratio of 0.5, and wherein the second impeller comprises a tip stagger angle of 55°, a hub stagger angle of 46° and a radius ratio of 0.5.

8. The two-stage axial fan of claim 7, wherein the first impeller comprises a tip camber angle of 23° and a hub camber angle of 41°, and wherein the second impeller comprises a tip camber angle of 27° and a hub camber angle of 37°.

9. The two-stage axial fan of claim 8, wherein the first impeller comprises a midspan solidity of 1.1 and an aspect ratio of 1.1, and wherein the second impeller comprises a midspan solidity of 0.8 and an aspect ratio of 1.0.

10. The two stage axial fan of any of claims 1-9, wherein the first impeller is positioned upstream of the second impeller and the first and second impellers are positioned between the first and second motors.

11. A two stage axial fan which comprises:

a tubular fan housing;

a first impeller which is positioned in the fan housing and is driven by a first motor; and a second impeller which is positioned in the fan housing and is driven by a second motor;

wherein the fan comprises a flow coefficient at free air which is greater than or equal to 0.15;

wherein the first impeller comprises a tip stagger angle of between 40° and 60° and a radius ratio of less than or equal to 0.6, and wherein the second impeller comprises a tip stagger angle of between 50° and 70° and a radius ratio of less than or equal to 0.6; and wherein the first and second impellers have different tip stagger angles and the same radius ratio.

12. The two-stage axial fan of claim 11, wherein the first impeller comprises a tip stagger angle of 45°, a hub stagger angle of 16° and a radius ratio of 0.5, and wherein the second impeller comprises a tip stagger angle of 55°, a hub stagger angle of 46° and a radius ratio of 0.5.

13. The two-stage axial fan of claim 12, wherein the first impeller comprises a tip camber angle of 23° and a hub camber angle of 41°, and wherein the second impeller comprises a tip camber angle of 27° and a hub camber angle of 37°.

14. The two-stage axial fan of claim 13, wherein the first impeller comprises a midspan solidity of 1.1 and an aspect ratio of 1.1, and wherein the second impeller comprises a midspan solidity of 0.8 and an aspect ratio of 1.0.

15. The two stage axial fan of claim 11, wherein the first and second impellers are driven by the motors to rotate in the same direction.

16. The two stage axial fan of claim 15, wherein the first motor is positioned upstream of the second motor, the first impeller is positioned between the first and second motors, and the second impeller is positioned downstream of the second motor.

17. The two stage axial fan of any of claim 11 or 12-14, wherein the first and second impellers are driven by the motors to rotate in opposite directions.

18. The two stage axial fan of claim 17, wherein the first motor is positioned upstream of the second motor and the first and second impellers are positioned between the first and second motors.

* * * * *